US012741186B2

(12) United States Patent
Luger

(10) Patent No.: US 12,741,186 B2
(45) Date of Patent: Sep. 22, 2026

(54) UPPER BODY SKI MOTION EXERCISE MACHINE

(71) Applicant: TORQUE FITNESS, LLC, Coon Rapids, MN (US)

(72) Inventor: Nathan Luger, Roseville, MN (US)

( * ) Notice: Subject to any disclaimer, the term of this patent is extended or adjusted under 35 U.S.C. 154(b) by 168 days.

(21) Appl. No.: 18/597,153

(22) Filed: Mar. 6, 2024

(65) Prior Publication Data

US 2025/0276231 A1 Sep. 4, 2025

Related U.S. Application Data

(60) Provisional application No. 63/560,300, filed on Mar. 1, 2024.

(51) Int. Cl.

| | |
|---|---|
| ***A63B 69/18*** | (2006.01) |
| ***A63B 21/00*** | (2006.01) |
| ***A63B 21/055*** | (2006.01) |
| ***A63B 21/16*** | (2006.01) |
| ***A63B 21/22*** | (2006.01) |
| ***A63B 23/12*** | (2006.01) |

(52) U.S. Cl.

CPC ..... *A63B 69/18* (2013.01); *A63B 21/151* (2013.01); *A63B 21/153* (2013.01); *A63B 21/16* (2013.01); *A63B 21/169* (2015.10); *A63B 21/4043* (2015.10); *A63B 23/12* (2013.01); *A63B 23/1263* (2013.01); *A63B 21/00069* (2013.01); *A63B 21/0552* (2013.01); *A63B 21/225* (2013.01); *A63B 21/4035* (2015.10)

(58) Field of Classification Search

CPC ..... A63B 21/00069; A63B 21/0552; A63B 21/151; A63B 21/153; A63B 21/157; A63B 21/16; A63B 21/169; A63B 21/225; A63B 21/4035; A63B 21/4043; A63B 23/03541; A63B 23/12; A63B 23/1263; A63B 69/18

See application file for complete search history.

(56) References Cited

U.S. PATENT DOCUMENTS

| | | | |
|---|---|---|---|
| D335,905 | S | 5/1993 | Cutter et al. |
| D351,435 | S | 10/1994 | Peterson et al. |
| 5,374,228 | A | 12/1994 | Buisman et al. |

(Continued)

FOREIGN PATENT DOCUMENTS

| | | | |
|---|---|---|---|
| CA | 2466543 | A1 | 7/2005 |
| WO | 2017123134 | A1 | 7/2017 |

OTHER PUBLICATIONS

Xebex Fitness Airplus Ski Trainer Smart Connect. Retrieved from the Internet: <URL: https://www.getrxd.com/xebex-fitness-airplus-ski-trainer-smart-connect-bundle.html>.

(Continued)

*Primary Examiner* — Megan Anderson

(74) *Attorney, Agent, or Firm* — Sherrill Law Offices PLLC; Michael Sherrill

(57) ABSTRACT

An upper body ski motion exercise machine that includes right and left spools, a single brake for applying resistance to rotation of the spools, right and left side elastic lines each having one end anchored and the other end secured to the respective spool, right and left side inelastic lines each having one end secured to the respective spool and a grip attached to the other end, wherein the elastic and inelastic lines are configured and arranged for inverse winding and unwinding on the spool.

15 Claims, 8 Drawing Sheets

(56) References Cited

U.S. PATENT DOCUMENTS

| | | | | |
|---|---|---|---|---|
| 5,387,168 | A | 2/1995 | Bostic | |
| 5,429,563 | A | 7/1995 | Engel et al. | |
| 5,830,114 | A | 11/1998 | Halfen et al. | |
| 6,030,321 | A * | 2/2000 | Fuentes | A63B 21/4013 482/74 |
| D425,940 | S | 5/2000 | Halfen et al. | |
| 11,786,777 | B1 * | 10/2023 | Sleamaker | A63B 21/156 482/110 |
| 2017/0319941 | A1 * | 11/2017 | Smith | A63B 24/0003 |
| 2020/0179749 | A1 | 6/2020 | Lindstrom | |
| 2022/0362620 | A1 * | 11/2022 | Chen | A63B 21/0442 |
| 2024/0108939 | A1 * | 4/2024 | Perry | A63B 23/03541 |

OTHER PUBLICATIONS

PB Extreme Ski Trainer Owner's Manual. Retrieved from the Internet: <URL: https://www.performbetter.com/CMS/Site-2/Published/Images/PB%20Extreme%20Ski%20Trainer%20Manual.pdf>.

Cascade Health & Fitness. Cascade Raptor Functional Trainer. Retrieved from the Internet: <URL: https://www.cascadehealthandfitness.com/wp-content/uploads/2023/12/2023-CascadeRAPTOR-FT-SalesSheet-with-QR-codes.pdf>.

Ercolina Upper Body Power. Retrieved from the Internet: <URL: https://www.upperbodypower.com/gb/>.

EnergyFit Rowing Machine: Ski-Row Air. Retrieved from the Internet: <URL: https://energy.fit/products/ski-row-air>.

Rally Fitness Commercial Air Ski Ergometer with Floor Stand. Retrieved from the Internet: <URL: https://rallyfitness.com/products/rally-fitness-ski-erg-with-floor-stand>.

Nordic Strong The Nordic Trainer (grey/green). Retrieved from the Internet: <URL: https://nordicstrong.com/products/the-nordic-trainer-2022>.

Concept 2 Rowerg Skierg Bikeerg Product Brochure. Retrieved from the Internet: <URL: https://www.concept2.com/files/pdf/us/indoor-rowers/RowerSkiErgBikeErg_Brochure.pdf>.

Fluid Power Zone FluidPower Erg Product Brochure. Retrieved from the Internet: <URL: https://fdflimited.com/wp-content/uploads/fluidpowerzone/brochure/FDF_FluidPowerZone_ERG_Brochure.pdf>.

* cited by examiner

UPPER BODY SKI MOTION EXERCISE MACHINE

BACKGROUND OF THE INVENTION

Variety in exercise options is an important aspect in maintaining an individual's interest and desire to continue exercising. It is also imperative that the equipment necessary for providing each of the exercise options have a minimal footprint and require modest space to perform the exercise so that the various pieces of equipment necessary to provide a wide variety of exercise options and the corresponding space required to utilize the equipment may be provided within a reasonably sized commercial fitness club or home exercise room.

Hence, a continuing need exists for exercise machines that offer new, novel, fresh, and innovative approaches and techniques for exercising, particularly when combined with a modest footprint for the machines and modest required exercising space.

SUMMARY OF THE INVENTION

The invention is an upper body ski motion exercise machine.

A first embodiment of the invention includes (i) a pair of spools, (ii) a single means for applying resistance to rotation of the pair of spools, (iii) right and left side inelastic lines, (iv) right and left side elastic lines, and (v) a pair of grips.

The pair of spools are laterally spaced right side and left side spools, each rotatable about a respective lateral axis of rotation. The single means for applying resistance to rotation of the pair of spools provides resistance to rotation of each spool about a respective lateral axis of rotation in a rotational direction, sans application of resistance to rotation of the pair of spools about the respective lateral axis of rotation in a counter rotational direction. The right side inelastic line has a first end restrained for a spaced relationship relative to the right spool lateral axis of rotation, and a second end secured to the right side spool. The left side inelastic line has a first end restrained for a spaced relationship relative to the left spool lateral axis of rotation, and a second end secured to the left side spool. The right side elastic line has a primary end secured to the right side spool and a secondary end restrained for maintaining a spaced relationship relative to the right side spool lateral axis of rotation. The left side elastic line has a primary end secured to the left side spool and a secondary end restrained for maintaining a spaced relationship relative to the left side spool lateral axis of rotation. The pair of grips include a right grip secured to the first end of the right side inelastic line, and a left grip secured to the first end of the left side inelastic line.

The right side inelastic line and right side elastic line are each configured and arranged relative to the right side spool so that rotation and counter-rotation of the right side spool effects corresponding winding and unwinding of the right side inelastic line on the right side spool with inverse winding and unwinding of the right side elastic line on the right side spool. In similar fashion, the left side inelastic line and left side elastic line are each configured and arranged relative to the left side spool so that rotation and counter-rotation of the left side spool effects corresponding winding and unwinding of the left side inelastic line on the left side spool with inverse winding and unwinding of the left side elastic line on the left side spool.

A second embodiment of the invention includes (i) a pair of spools, (ii) a single means for applying resistance to rotation of the pair of spools, (iii) right and left side inelastic lines, (iv) right and left side elastic lines, and (v) a pair of grips.

The pair of spools are laterally spaced right side and left side spools each rotatable about a respective lateral axis of rotation. The single means for applying resistance to rotation of the pair of spools provides resistance to rotation of each spool about a respective lateral axis of rotation in a rotational direction, sans application of resistance to rotation of the pair of spools about the respective lateral axis of rotation in a counter rotational direction.

The right side inelastic line has a first end restrained for a spaced relationship relative to the right spool lateral axis of rotation, and a second end secured to the right side spool for (i) winding a length of the right side inelastic line proximate the second end of the right side inelastic line onto the right side spool when the right side spool is rotated in the counter rotational direction, and (ii) unwinding a length of the right side inelastic line proximate the second end of the right side inelastic line from the right side spool against the resistance applied by the single means for applying resistance when the right side spool is rotated in the rotational direction by a force pulling the first end of the right side inelastic line away from the right spool lateral axis of rotation. In similar fashion, the left side inelastic line has a first end restrained for a spaced relationship relative to the left spool lateral axis of rotation and a second end secured to the left side spool for (i) winding a length of the left side inelastic line proximate the second end of the left side inelastic line onto the left side spool when the left side spool is rotated in the counter rotational direction, and (ii) unwinding a length of the left side inelastic line proximate the second end of the left side inelastic line from the left side spool against the resistance applied by the single means for applying resistance when the left side spool is rotated in the rotational direction by a force pulling the first end of the left side inelastic line away from the left spool lateral axis of rotation. The pair of grips include a right grip secured to the first end of the right side inelastic line, and a left grip secured to the first end of the left side inelastic line.

The right side elastic line has a secondary end restrained for maintaining a spaced relationship relative to the right side spool lateral axis of rotation, and a primary end secured to the right side spool whereby a length of the right side elastic line proximate the primary end of the right side elastic line is operable for (i) winding onto the right side spool when the right side spool is rotated in the rotational direction so as to stretch the right side elastic line and thereby create a biasing force favoring rotation of the right side spool in the counter rotation direction, and (ii) unwinding from the right side spool when the right side spool is counter rotated by the bias of the stretched right side elastic line. In similar fashion, a left side elastic line has a secondary end restrained for maintaining a spaced relationship relative to the left side spool lateral axis of rotation, and a primary end secured to the left side spool whereby a length of the left side elastic line proximate the primary end is operable for (i) winding onto the left side spool when the left side spool is rotated in the rotational direction so as to stretch the left side elastic line and thereby create a biasing force favoring rotation of the left side spool in the counter rotation direction, and (ii) unwinding from the left side spool when the left side spool is counter rotated by the bias of the stretched left side elastic line.

The upper body ski motion exercise machine can include a spaced pair of right pulleys with an intermediate length of the right elastic line looped repeatedly around the pair of right pulleys, and a spaced pair of left pulleys with an intermediate length of the left elastic line looped repeatedly around the pair of left pulleys.

DETAILED DESCRIPTION OF AN ILLUSTRATIVE EMBODIMENT OF THE INVENTION

Definitions

Figure 1:
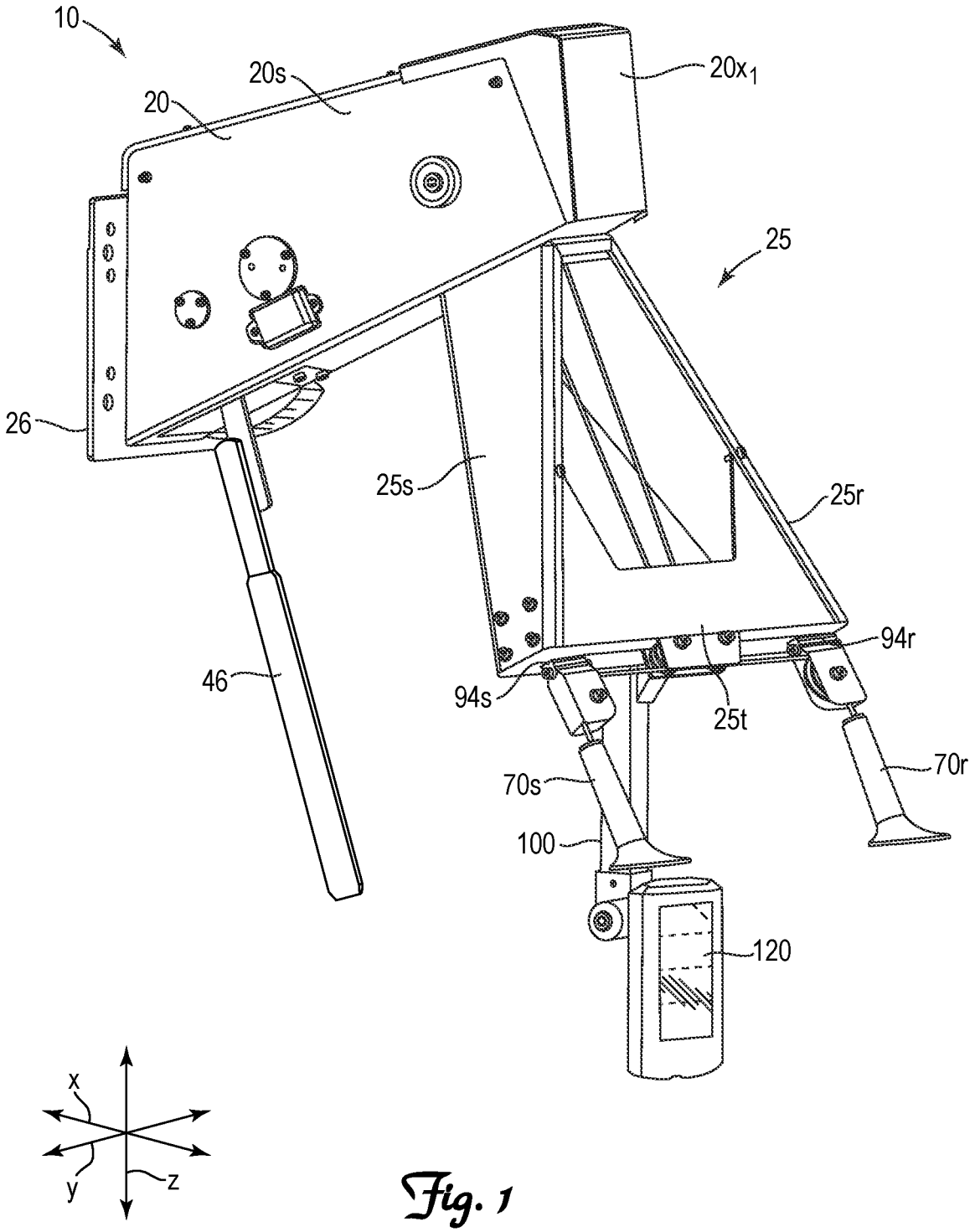
FIG. 1 is a perspective view of one embodiment of the invention.

As utilized herein, the term compact, in reference to the exercise machine in accordance with this invention, means an exercise machine that when in a rest or inactive mode has all moving components (i.e., components that translate, expand, contract, rotate and/or pivot during use of the machine excluding components that are optionally moved when customizing machine settings such as resistance level or location of the display) that can either (i) fit within a single rectangular cuboid having a longitudinal depth of less than 3 feet, a lateral width of less than 3 feet and a transverse vertical height of less than 4 feet or (ii) fit within a single hexahedron having a volume less than 30 $ft^2$. In similar fashion, as utilized herein, the term ultra compact an exercise machine that when in a rest or inactive mode has all moving components (i.e., components that translate, expand, contract, rotate and/or pivot during use of the machine excluding components that are optionally moved when customizing machine settings such as resistance level or location of the display) that can either (i) fitting within a single rectangular cuboid having a longitudinal depth of less than 2.5 feet, a lateral width of less than 2.5 feet and a transverse vertical height of less than 3 feet, or (ii) fitting within a single hexahedron having a volume less than 20 $ft^2$.

As utilized herein, the term elevated, in reference to an exercise machine in accordance with this invention, means an exercise machine that when stably supported upon a floor in a position and configuration for immediate use, and when in a rest or inactive mode, has all moving components (i.e., components that translate, expand, contract, rotate and/or pivot during use of the machine excluding components that are optionally moved when customizing machine settings such as resistance level or location of the display) at least 4 feet above the floor. In similar fashion, as utilized herein, the term peak elevated means all moving components are at least 5 feet above the floor.

As utilized herein, the phrase top mount, in reference to an exercise machine in accordance with this invention, means an exercise machine that when in a rest or inactive mode has the grips positioned vertically below all other moving components (i.e., components that translate, expand, contract, rotate and/or pivot during use of the machine excluding components that are optionally moved when customizing machine settings such as resistance level or location of the display).

As utilized herein, the directional terms right and left are made from the perspective of a user facing the front of the exercise machine.

Nomenclature Table

| REF. NO. | NAME |
|---|---|
| 10 | Upper Body Ski Motion Exercise Machine |
| 20 | Housing |
| 20r | Right Side of Housing |
| 20s | Left Side of Housing |
| $20x_1$ | Front of Housing |
| $20x_2$ | Back of Housing |
| $20z_1$ | Top of Housing |
| $20z_2$ | Bottom of Housing |
| 25 | Guide Frame |
| 25r | Right Side Arm of Guide Frame |
| 25s | Left Side Arm of Guide Frame |
| 25t | Cross Member of Guide Frame |
| 26 | Mounting Bracket |
| 30 | Spools |
| 30r | Right Side Spool |
| 30s | Left Side Spool |
| 30y | Spool Axis of Rotation |
| 31r | Right Side Spool Inelastic Line Retention Zone |
| 32r | Right Side Spool Elastic Line Retention Zone |
| 31s | Left Side Spool Inelastic Line Retention Zone |
| 32s | Left Side Spool Elastic Line Retention Zone |
| 33 | Helical Groove on the Spools |
| 33r | Right Side Spool Shared Helical Groove |
| 33s | Left Side Spool Shared Helical Groove |
| 34d | Distal Lateral End of Each of Right and Left Side Spools |
| 34p | Proximal Lateral End of Each of Right and Left Side Spools |
| 35 | Resistance Communicating Pulley |
| $37_1$ | Rotational Direction Around Spool Axis of Rotation |
| $37_2$ | Counter Rotational Direction Around Spool Axis of Rotation |
| 40 | Resistance or Braking Device |
| 45 | Belt Transmitting Resistance from Resistance Device to Spools |
| 46 | Resistance Level Adjustment Lever |
| 50 | Inelastic Lines 50r and 50s |
| 50r | Right Side Inelastic Line |
| 51r | First End of Right Side Inelastic Line |
| 52r | Second End of Right Side Inelastic Line |
| 50s | Left Side Inelastic Line |
| 51s | First End of Left Side Inelastic Line |
| 52s | Second End of Left Side Inelastic Line |
| 60 | Elastic Lines 60r and 60s |
| 60r | Right Side Elastic Line |
| 61r | Primary End of Right Side Elastic Line |
| 62r | Secondary End of Right Side Elastic Line |
| 63r | Intermediate Length of Right Side Elastic Line |
| 60s | Left Side Elastic Line |
| 61s | Primary End of Left Side Elastic Line |
| 62s | Secondary End of Left Side Elastic Line |
| 63s | Intermediate Length of Left Side Elastic Line |
| 70 | Grips 70r and 70s |
| 70r | Right Grip |
| 70s | Left Grip |
| 80 | Looping Pulleys 81 and 82 |
| 81 | First Looping Pulleys |
| 81r | Right Side First Looping Pulley |
| 81s | Left Side First Looping Pulley |
| 82 | Second Looping Pulleys |

-continued

Nomenclature Table

| REF. NO. | NAME |
|---|---|
| 82r | Right Side Second Looping Pulley |
| 82s | Left Side Second Looping Pulley |
| 90 | Guide Pulleys 91 and 92 |
| 91 | First Guide Pulleys 91r and 91s |
| 91r | First Right Side Guide Pulley |
| 91rz | First Right Side Guide Pulley Transverse Axis of Rotation |
| 91s | First Left Side Guide Pulley |
| 91sz | First Left Side Guide Pulley Transverse Axis of Rotation |
| 92 | Second Guide Pulleys 92r and 92s |
| 92r | Second Right Side Guide Pulley |
| 92rz | Second Right Side Guide Pulley Transverse Axis of Rotation |
| 92s | Second Left Side Guide Pulley |
| 92sz | Second Left Side Guide Pulley Transverse Axis of Rotation |
| 93 | Second Guide Pulley Mounting Fixtures 93r and 93s |
| 93r | Right Side Second Guide Pulley Mounting Fixture |
| 93s | Left Side Second Guide Pulley Mounting Fixture |
| 94 | Hinges on Second Guide Pulley Mounting Fixtures 94r and 94s |
| 94r | Hinge on Right Side Second Guide Pulley Mounting Fixture |
| 94ry | Lateral Pivot Axis of Right Side Hinge |
| 94s | Hinge on Left Side Second Guide Pulley Mounting Fixture |
| 94sy | Lateral Pivot Axis of Left Side Hinge |
| 100 | Articulating Linkage |
| 101 | First End of Articulating Linkage |
| 102 | Second End of Articulating Linkage |
| 120 | Display |
| x | Longitudinal (Front to Back or Depth) Direction and Dimension |
| y | Lateral (Side to Side or Width) Direction and Dimension |
| z | Transverse (Top to Bottom or Height) Direction and Dimension |

Construction

Referring to FIGS. 1-6, the invention is an upper body ski motion exercise machine 10 and most preferably a compact upper body ski motion exercise machine 10. A particular embodiment of the exercise machine 10 includes a frame or preferably an enclosing housing 20, a pair of spools 30, a resistance device 40, right side and left side inelastic lines 50*r* and 50*s*, right side and left side elastic lines 60*r* and 60*s*, a pair of grips 70, a pair of looping pulleys 80, and guide pulleys 90 such as a pair of first guide pulleys 91, and a pair of second guide pulleys 92.

Figure 2:
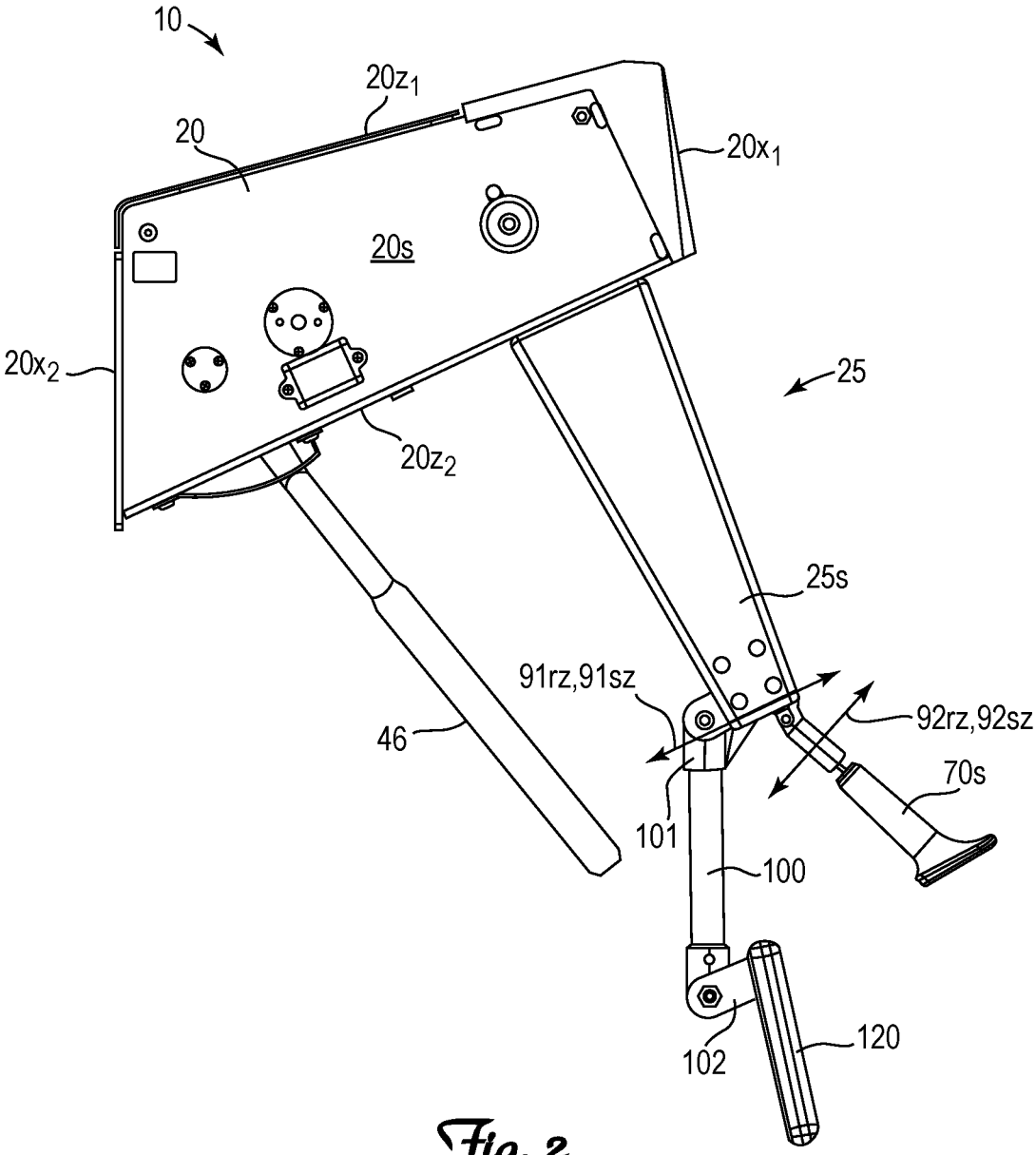
FIG. 2 is a side view of the invention depicted in FIG. 1.
Figure 3:
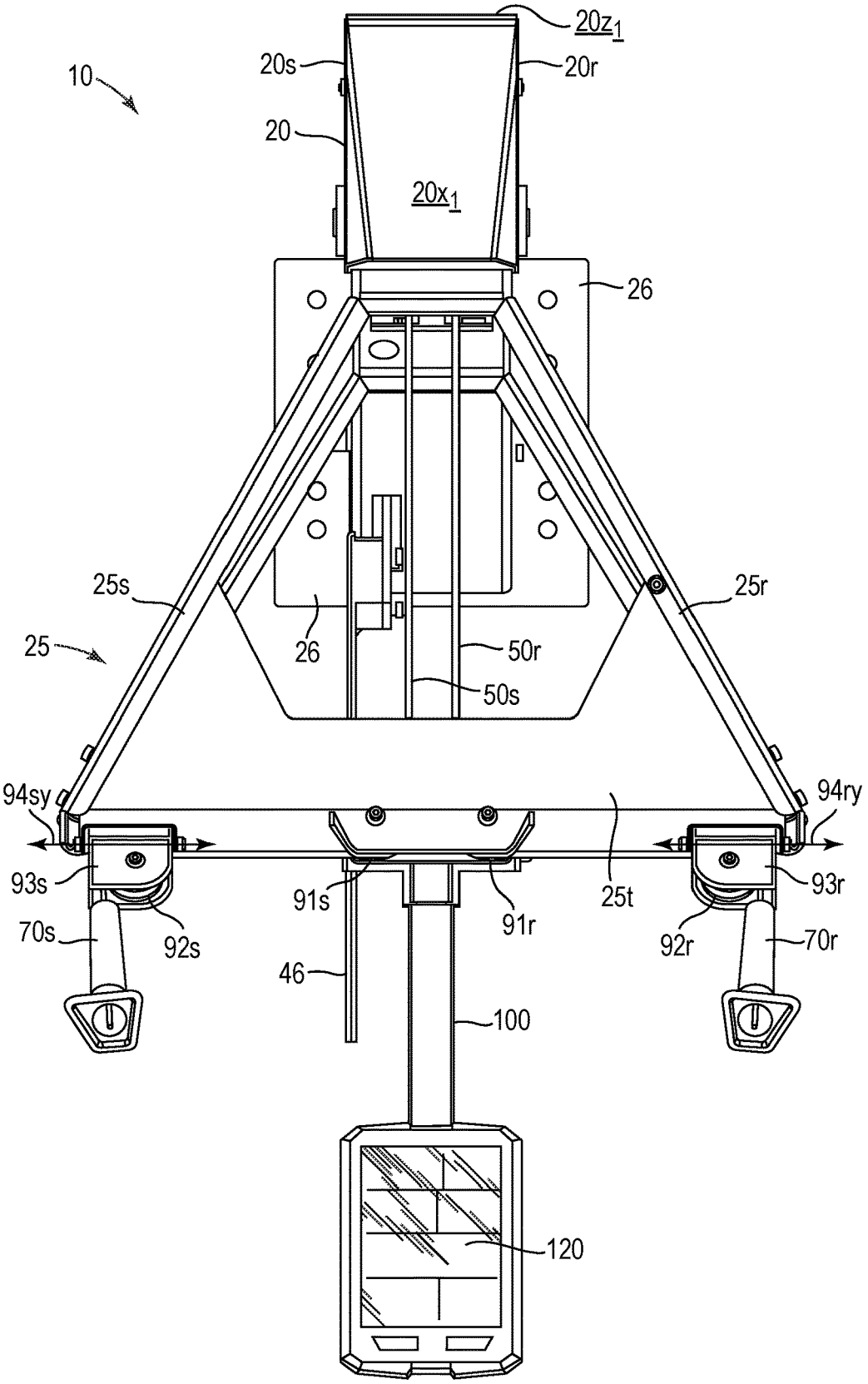
FIG. 3 is a front view of the invention depicted in FIG. 1.

Referring to FIGS. 1-3, the housing 20 includes a right side panel 20*r*, a left side panel 20*s*, a front panel $\mathbf{20}x_1$, a rear panel $\mathbf{20}x_2$, a top panel $\mathbf{20}z_1$ and a bottom panel $\mathbf{20}z_2$. The housing 20 can protectively and aesthetically encompass and shroud the pair of spools 30, the resistance device 40, the right side and left side inelastic lines 50*r* and 50*s*, the right side and left side elastic lines 60*r* and 60*s*, and the pair of looping pulleys 80. The housing 20 also provides anchoring points for these various components.

Referring to FIGS. 1-4, a guide frame 25 can extend longitudinally x down from the bottom $\mathbf{20}z_2$ of the housing 20, having laterally y diverging right side and left side guide arms 25*r* and 25*s* for supporting a right and left lateral y spacing of right and left grips 70*r* and 70*s*. The lateral y spacing between the right and left grips 70*r* and 70*s* should allow a user's arms to extend parallel to one another when holding the grips 70 proximate the guide arms 25*r* and 25*s*. A lateral y spacing of about 1.5 to 2.5 feet should generally be effective. A lateral y cross member 25*t* can connect the free terminal end portions (unnumbered) of the right and left guide arms 25*r* and 25*s* to improve the structural integrity of the guide frame 25.

Figure 4:
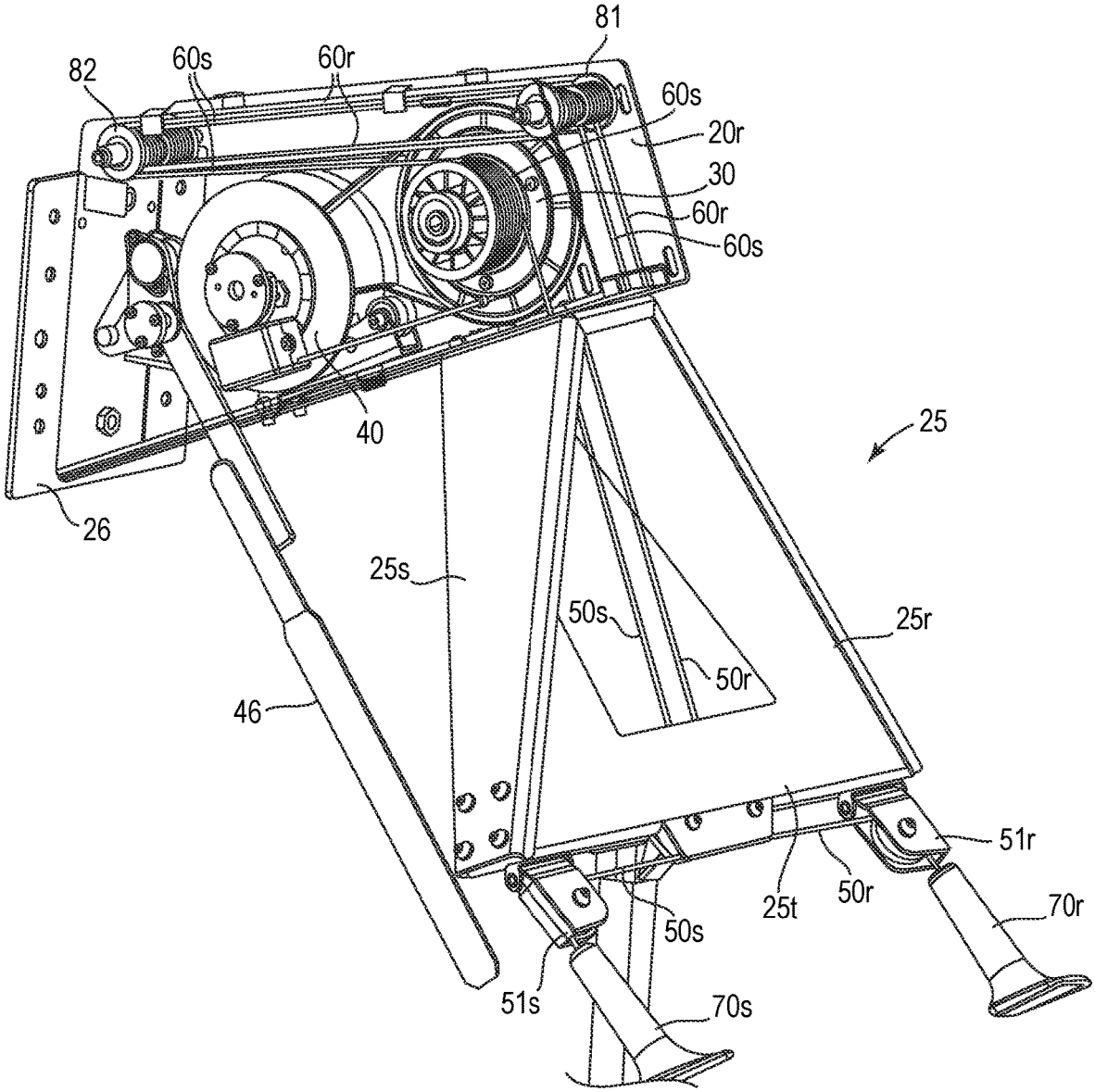
FIG. 4 is a perspective view of the invention depicted in FIG. 1 with the housing removed to facilitate depiction of the internal components.

Referring to FIGS. 1 and 4, a mounting bracket 26 for mounting the upper body ski motion exercise machine 10 to a vertical structure such as a wall or an exercise frame (not shown) can be provided at the back $\mathbf{20}x_2$ of the housing 20. When mounted, the upper body ski motion exercise machine 10 is preferably an elevated exercise machine and more preferably a top mount elevated exercise machine.

Figure 7:
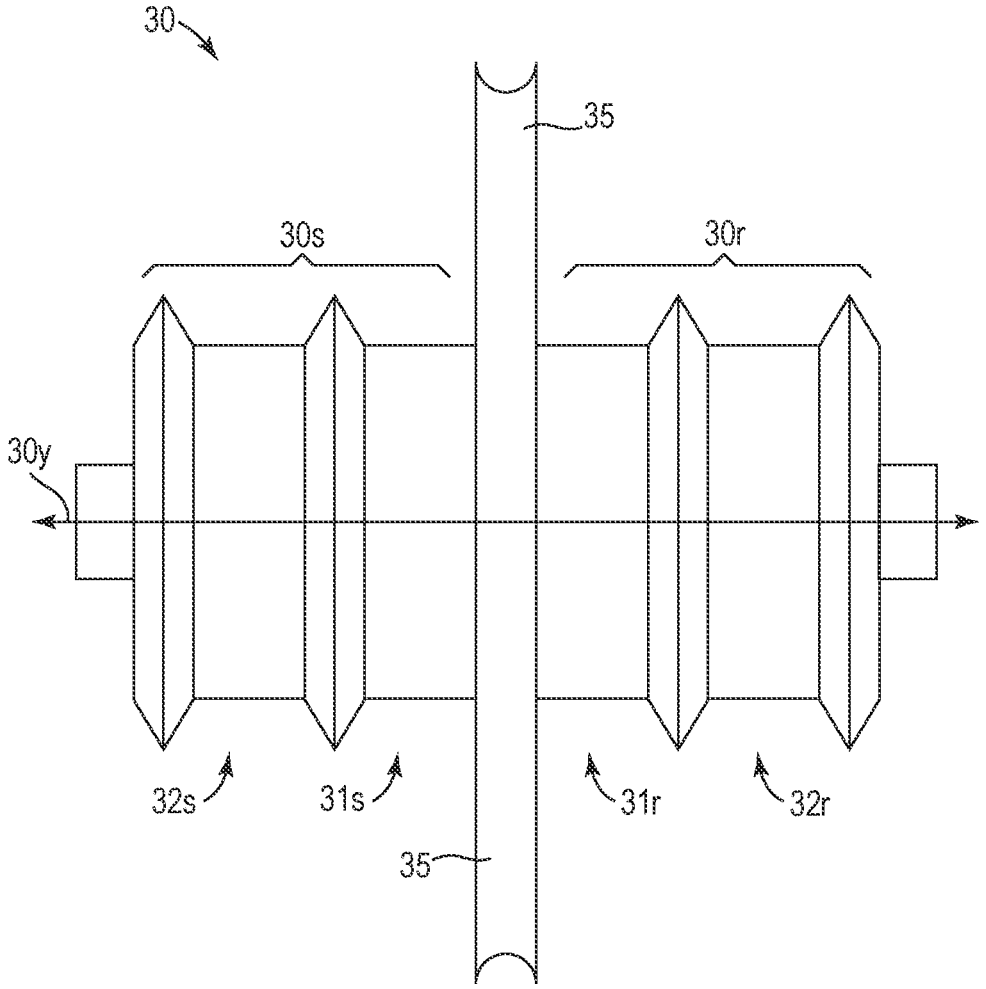
FIG. 7 is a top view of one embodiment of the spool component of the invention depicted in FIG. 4.

Referring to FIG. 7, the pair of spools 30 include laterally y spaced right side and left side spools 30*r* and 30*s*, each rotatably secured to the housing 20 and rotatable in rotational $\mathbf{37}_1$ and counter-rotational $\mathbf{37}_2$ directions about a respective lateral y axis of rotation 30*y*. The axis of rotation 30*y* may be different for each of the right side and left side spools 30*r* and 30*s*, but as depicted in FIG. 7, the right side and left side spools 30*r* and 30*s* preferably rotate about a common axis of rotation 30*y*.

Still referring to FIG. 7, each of the right side and left side spools 30*r* and 30*s* can be divided into two distinct laterally y separated retention zones for providing separate volumes for retention of inelastic 50 and elastic 60 lines wound onto the spools 30. The right side spool 30*r* can be divided by a circumferential shoulder (unnumbered) into a right side spool 30*r* inelastic line retention zone 31*r* and a right side spool 30*r* elastic line retention zone 32*r*. In mirror image fashion, the left side spool 30*s* can be divided by a circumferential shoulder (unnumbered) into a left side spool 30*s* inelastic line retention zone 31*s* and a left side spool 30*s* elastic line retention zone 32*s*.

Figure 8:
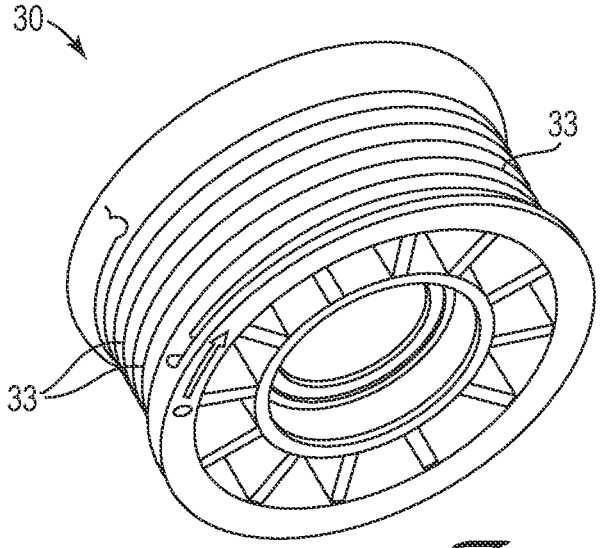
FIG. 8 is a perspective view of one side of an alternative embodiment of the spool component of the invention depicted in FIG. 4.
Figure 8A:
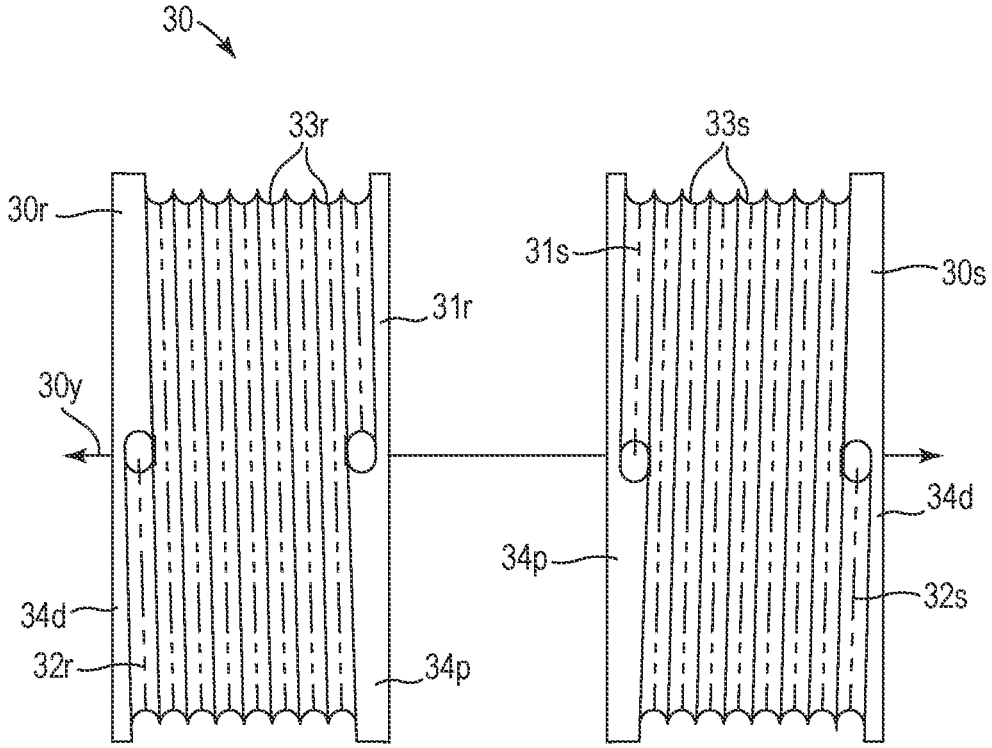
FIG. 8A is a rear view of both right and left sides of the alternative embodiment of the spool component depicted in FIG. 8, with the option of the elastic line secured to the distal lateral end of each spool and the inelastic line secured to the proximal lateral end of each spool.

Referring to FIGS. 8 and 8A, an alternative embodiment of the spools 30 for guided winding and unwinding of the inelastic 50 and elastic 60 lines onto and off from the spools 30 employs right side and left side spools 30*r* and 30*s* each of which have a single continuous helical groove 33*r* and 33*s* respectively, shared by the corresponding set of right side inelastic 50*r* and elastic 60*r* lines on the right side spool 30*r* and corresponding set of left side inelastic 50*s* and left side elastic 60*s* lines on the left side spool 30*r*. One of the lines 50 or 60 on each of the spools 30 has an end (i.e., the second end 52 of the inelastic line 50 or the primary end 61 of the elastic line 60) secured immediate the proximal lateral end 34*p* of the helical groove 33 on each spool 30 which is wound in a clockwise direction onto the helical groove 33 while the other of the lines 50 or 60 on the spools 30 has an end (i.e., the second end 52 of the inelastic line 50 or the primary end 61 of the elastic line 60) secured immediate the distal lateral end 34*d* of the helical groove 33 on each spool 30 which is wound in a counter-clockwise direction onto the helical groove 33. This configuration of laterally y spaced connection of the inelastic 50 and elastic 60 lines to each spool 30 and counter windings of the inelastic 50 and elastic 60 lines onto each spool 30 allows the lines 50 and 60 on each spool 30 to share the same helical groove 33 because as one of the lines 50 or 60 winds onto the helical groove 33 the other line 50 or 60 unwinds from the helical groove 33, leaving windings of the groove 33 open and available for occupancy by the line 50 or 60 winding onto the helical groove 33. Sharing of a single continuous helical groove 33*r* and 33*s* on each spool 30*r* and 30*s* minimizes the overall lateral y width of the exercise machine 10 and adds to the compact nature of the machine 10.

Figure 5:
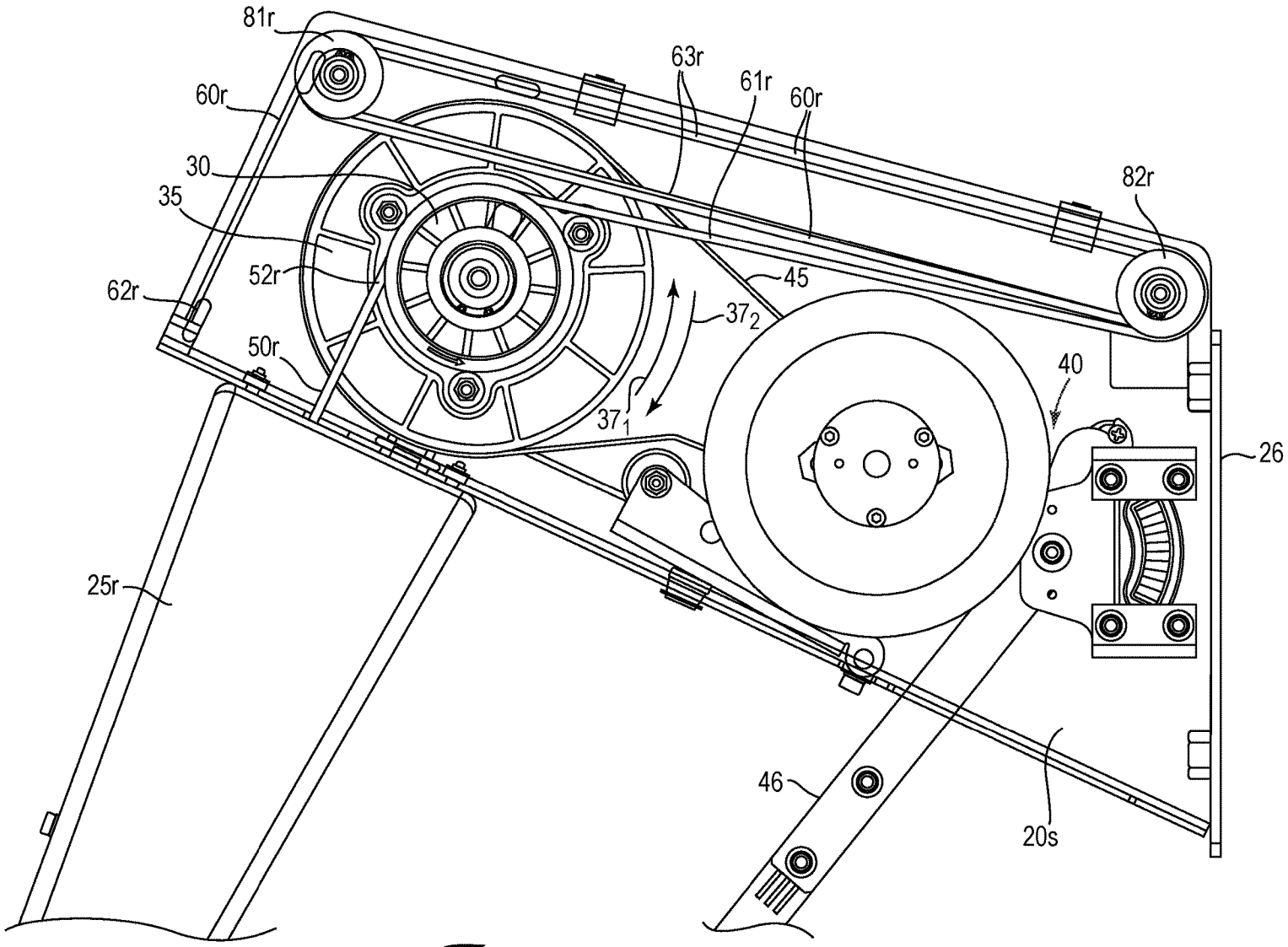
FIG. 5 is a right side view of the invention depicted in FIG. 4 with the right side panel of the housing removed to facilitate depiction of the internal components.
Figure 6:
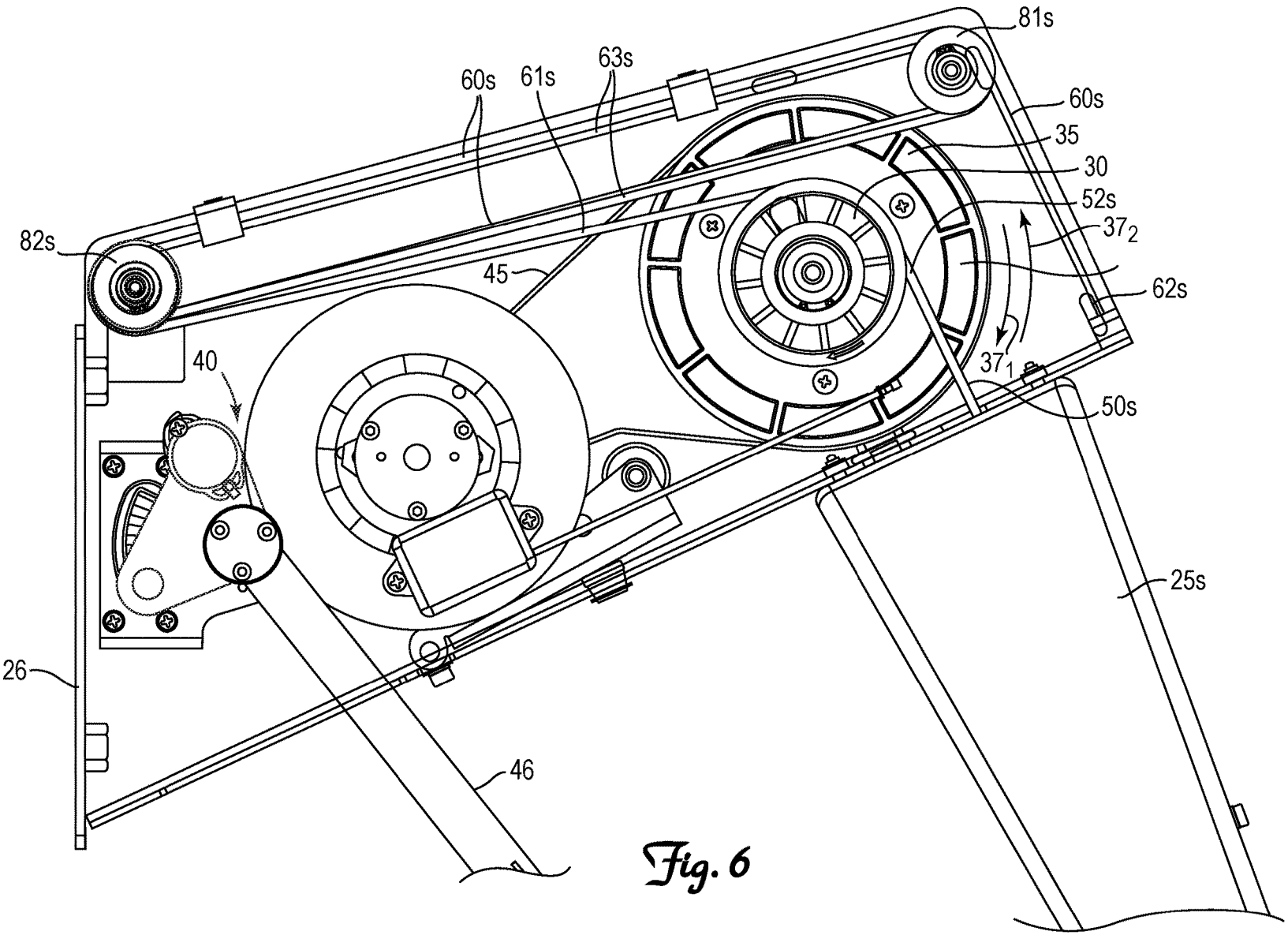
FIG. 6 is a left side view of the invention depicted in FIG. 4 with the left side panel of the housing removed to facilitate depiction of the internal components.

Referring to FIGS. 4-6, the means for applying resistance 40 to rotation of the pair of spools 30 about the respective lateral y axis of rotation 30*y* is rotatably secured to the housing 20 and provides resistance in only one rotational direction (e.g., a clutched brake for applying resistance in the rotational direction $\mathbf{37}_1$ but not in the counter-rotational direction $\mathbf{37}_2$). The means for applying resistance 40 transmits the resistance to the pair of spools 30 via a belt 45 that loops around a pulley (unnumbered) on the means for applying resistance 40 and around a resistance communicating pulley 35 concentrically affixed to the pair of spools 30. The means for applying resistance 40 can be selected from any of the various braking devices used upon exercise machines, including, specifically but not exclusively, friction, hydraulic, magnetic, electromagnetic, air resistance, etc.

Referring to FIGS. 1-6, a lever 46 or equivalent mechanism, such as a pull cord or dial, may be provided to allow user adjustment to the resistance level. Referring to FIGS. 1 and 2, an indicia plate (unnumbered) with resistance level markings viewable from the front of the exercise machine 10 can be provided.

Referring to FIGS. 1, 3 and 4, the right side and left side inelastic lines 50*r* and 50*s* are mirror images of one another. As the name implies, both are inelastic lengths of rope, cable, cord or similar material.

The right side inelastic line 50*r* has a first end 51*r* and a second end 52*r*. The first end 51*r* projects out from the lower distal end (unnumbered) of the guide frame 25 proximate the right side arm 25*r* with a right grip 70*r* secured to the first end 51*r*. The second end 52*r* is secured to the right side spool 30*r* for winding and unwinding of the right side inelastic line 50*r* onto and from around the right side spool 30*r*. To provide a desired positioning and orientation of the right grip 70*r*, the right side inelastic line 50*r* can be sequentially redirected from the second end 52*r* by a first right side guide pulley 91*r* rotatably mounted to the cross member 25*t* of the guide frame 25 proximate the lateral y center of the guide frame 25 for rotation about a first right side guide pulley transverse axis of rotation 91*rz* and then by a second right side guide pulley 92*r* rotatably mounted to the guide frame 25 proximate the lower distal end of the guide frame 25 proximate the right side arm 25*r* for rotation about a second right side guide pulley transverse axis of rotation 92*rz*.

The first end 51*r* can be conveniently restrained from being pulled into contact with the second right side guide pulley 92*r* by configuring a right side second guide pulley mounting fixture 93*r* supporting and encompassing the second right side guide pulley 92*r* so as to allow passage of the right side inelastic line 50*r* into engagement with the second right side guide pulley 92*r* but not the right grip 70*r*.

In mirror fashion, the left side inelastic line 50*s* has a first end 51*s* and a second end 52*s*. The first end 51*s* projects out from the lower distal end (unnumbered) of the guide frame 25 proximate the left side arm 25*s* with a left grip 70*s* secured to the first end 51*s*. The second end 52*s* is secured to the left side spool 30*s* for winding and unwinding of the left side inelastic line 50*s* onto and from around the left side spool 30*s*. To provide a desired positioning and orientation of the left grip 70*s*, the left side inelastic line 50*s* can be sequentially redirected from the second end 52*s* by a first left side guide pulley 91*s* rotatably mounted to the cross member 25*t* of the guide frame 25 proximate the lateral y center of the guide frame 25 for rotation about a first left side guide pulley transverse z axis of rotation 91*sz* and then by a second left side guide pulley 92*s* rotatably mounted to the guide frame 25 proximate the lower distal end of the guide frame 25 proximate the left side arm 25*s* for rotation about a second left side guide pulley transverse axis of rotation 92*sz*.

The first end 51*s* can be conveniently restrained from being pulled into contact with the second left side guide pulley 92*s* by configuring a left side second guide pulley mounting fixture 93*s* supporting and encompassing the second left side guide pulley 92*s* so as to allow passage of the left side inelastic line 50*s* into engagement with the second left side guide pulley 92*s* but not the left grip 70*s*.

Referring to FIGS. 1-4, each of the right side and left side second guide pulley mounting fixtures 93*r* and 93*s* can be attached to the guide frame 25 by hinges 94*r* and 94*s* respectively, with each hinge 94*r* and 94*s* allowing pivoting of the associated second guide pulley mounting fixtures 93*r* and 93*s* and thereby the associated second guide pulleys 92*r* and 92*s* about a lateral y pivot axis 94*ry* and 94*sy* respectively. This accommodates pulling of the grips 70 in the longitudinal x direction away from the guide frame 25 at different angles relative to the transverse direction z.

Referring to FIGS. 4-6, the right side and left side elastic lines 60*r* and 60*s* are mirror images of one another. As the name implies, both are elastic lengths of rope, cord or similar material, commonly generically referenced as bungee cords.

To provide a length of each of the right and left side elastic lines 60*r* and 60*s* capable of accommodating a full range of motion to the right and left grips 70*r* and 70*s* respectively, as necessary to allow emulation of upper body and right arm movement during skiing from a compact housing 20, an intermediate length 63*r* and 63*s* of each of the right side and left side elastic lines 60*r* and 60*s* respectively, may be looped one or more times around spaced first and second looping pulleys 81 and 82.

The right side elastic line 60*r* has a primary end 61*r* and a secondary end 62*r*. The secondary end 62*r* is secured to the housing 20. The primary end 61*r* is secured to the right side spool 30*r* for winding and unwinding of the right side elastic line 60*r* onto and from around the right side spool 30*r*. To provide a length of the right side elastic line 60*r* capable of accommodating a full range of motion to the right grip 70*r* as necessary to allow emulation of upper body and right arm movement during skiing from a compact housing 20, an intermediate length 63*r* of the right side elastic line 60*r* may be looped one or more times around and between a first pair of spaced right side first and second looping pulleys 81*r* and 82*r* with a preference for two to five loops.

In mirror fashion, the left side elastic line 60*s* has a primary end 61*s* and a secondary end 62*s*. The secondary end 62*s* is secured to the housing 20. The primary end 61*s* is secured to the left side spool 30*s* for winding and unwinding of the left side elastic line 60*s* onto and from around the left side spool 30*s*. To provide a length of the left side elastic line 60*s* capable of accommodating a full range of motion to the left grip 70*s* as necessary to allow emulation of upper body and left arm movement during skiing from a compact housing 20, an intermediate length 63*s* of the left side elastic line 60*s* may be looped one or more times around and between a pair of spaced left side first and second looping pulleys 81*s* and 82*s* with a preference for two to five loops.

The inelastic lines 50 and elastic lines 60 are secured to the spools 30 so that as one is unwound from the spools 30 the other is wound onto the spools 30 and vice versa. More specifically, pulling downward on the right and left grips 70*r* and 70*s* with sufficient force to overcome the resistance exerted by the resistance device 40 and translate the grips 70 away from the spools 30 causes the right and left inelastic lines 50*r* and 50*s* to unwind from the right and left spools 30*r* and 30*s* respectively, rotating the spools 30*r* and 30*s* and causing the right and left elastic lines 60*r* and 60*s* to wind onto the right and left spools 30*r* and 30*s* respectively. This winding of the right and left elastic lines 60*r* and 60*s* onto the right and left spools 30*r* and 30*s* respectively creates a biasing counter-rotation $\mathbf{37}_2$ pull force in the elastic lines 60.

Upon diminishment of the pulling force below the biasing pull force in the elastic lines 60*r* and 60*s*, the biasing pull force can effect counter-rotation $\mathbf{37}_2$ of the spools 30*r* and 30*s* and thereby unwind the right and left elastic lines 60*r* and 60*s* from the right and left spools 30*r* and 30*s* with concomitant diminishment of the biasing force, and with concomitant winding of the right and left inelastic lines 50*r* and 50*s* onto the right and left spools 30*r* and 30*s* respectively, until further return of the right and left inelastic lines 50*r* and 50*s* is prevented such as by the right and left grips 70*r* and 70*s* engaging the second guide pulley mounting fixtures 93*r* and 93*s* respectively.

Referring to FIGS. 1-3, a display 120 in communication with sensors (not shown) on the machine 10 can be provided for displaying relevant selected exercise parameters and performance details to a user during exercise, such as distance, power, calories burned, elapsed time, etc. One suitable embodiment is attaching the display 120 to the exercise machine 10 via a repositionable articulating linkage 100 attached at a first end 101 to the guide frame 25 with the display 120 attached to the second end 102.

I claim:

1. A top mount and elevated upper body ski motion exercise machine, comprising:

(a) a pair of laterally spaced right side and left side spools each rotatable about a respective lateral axis of rotation, (b) a single means for applying resistance to rotation of the pair of laterally spaced right side and left side spools about the respective lateral axis of rotation in a rotational direction, sans application of resistance to rotation of the pair of laterally spaced right side and left side spools about the respective lateral axis of rotation in a counter rotational direction, (c) a right side inelastic line having a first end and a second end wherein the first end of the right side inelastic line is restrained for a spaced relationship relative to the lateral axis of rotation of the right spool of the pair of laterally spaced right side and left side spools and the second end of the right side inelastic line is secured to the right side spool, (d) a left side inelastic line having a first end and a second end wherein the first end of the left side inelastic line is restrained for a spaced relationship relative to the lateral axis of rotation of the left spool of the pair of laterally spaced right side and left side spools and the second end of the left side inelastic line is secured to the left side spool, (e) a right grip secured to the first end of the right side inelastic line, (f) a left grip secured to the first end of the left side inelastic line, (g) a right side elastic line having a primary end and a secondary end wherein the secondary end of the right side elastic line is restrained for maintaining a spaced relationship relative to the lateral axis of rotation of the right side spool, and the primary end of the right side elastic line is secured to the right side spool, (h) a left side elastic line having a primary end and a secondary end wherein the secondary end of the left side elastic line is restrained for maintaining a spaced relationship relative to the lateral axis of rotation of the left side spool, and the primary end of the left side elastic line is secured to the left side spool, (i) wherein the right side inelastic line and right side elastic line are each configured and arranged relative to the right side spool that rotation and counter-rotation of the right side spool effects corresponding winding and unwinding of the right side inelastic line on the right side spool with inverse winding and unwinding of the right side elastic line on the right side spool, and (j) wherein the left side inelastic line and left side elastic line are each configured and arranged relative to the left side spool that rotation and counter-rotation of the left side spool effects corresponding winding and unwinding of the left side inelastic line on the left side spool with inverse winding and unwinding of the left side elastic line on the left side spool.

2. The upper body ski motion exercise machine of claim 1 wherein the upper body ski motion exercise machine is compact.

3. The upper body ski motion exercise machine of claim 1 wherein the pair of laterally spaced right side and left side spools are rotatable in tandem about a common lateral axis of rotation.

4. An upper body ski motion exercise machine, comprising:

(a) a pair of laterally spaced right side and left side spools each rotatable about a respective lateral axis of rotation, (b) a single means for applying resistance to rotation of the pair of laterally spaced right side and left side spools about the respective lateral axis of rotation in a rotational direction, sans application of resistance to rotation of the pair of laterally spaced right side and left side spools about the respective lateral axis of rotation in a counter rotational direction, (c) a right side inelastic line having a first end and a second end wherein the first end of the right side inelastic line is restrained for a spaced relationship relative to the lateral axis of rotation of the right spool of the pair of laterally spaced right side and left side spools and the second end of the right side inelastic line is secured to the right side spool for (i) winding a length of the right side inelastic line proximate the second end of the right side inelastic line onto the right side spool when the right side spool is rotated in the counter rotational direction, and (ii) unwinding a length of the right side inelastic line proximate the second end of the right side inelastic line from the right side spool against the resistance applied by the single means for applying resistance when the right side spool is rotated in the rotational direction by a force pulling the first end of the right side inelastic line away from the right spool lateral axis of rotation, (d) a left side inelastic line having a first end and a second end wherein the first end of the left side inelastic line is restrained for a spaced relationship relative to the lateral axis of rotation of the left spool of the pair of laterally spaced right side and left side spools and the second end of the left side inelastic line is secured to the left side spool for (i) winding a length of the left side inelastic line proximate the second end of the left side inelastic line onto the left side spool when the left side spool is rotated in the counter rotational direction, and (ii) unwinding a length of the left side inelastic line proximate the second end of the left side inelastic line from the left side spool against the resistance applied by the single means for applying resistance when the left side spool is rotated in the rotational direction by a force pulling the first end of the left side inelastic line away from the left spool lateral axis of rotation, (e) laterally spaced right side and left side guide pulleys, each separately rotatable about a longitudinal axis and each separately pivotable about a laterally extending axis, with (i) the right side inelastic line guided by the right side guide pulley proximate the first end of the right side inelastic line, and (ii) the left side inelastic line guided by the left side guide pulley proximate the first end of the left side inelastic line, (f) a right grip secured to the first end of the right side inelastic line, (g) a left grip secured to the first end of the left side inelastic line, (h) a right side elastic line having a primary end and a secondary end wherein the secondary end of the right side elastic line is restrained for maintaining a spaced relationship relative to the lateral axis of rotation of the right side spool, and the primary end of the right side elastic line is secured to the right side spool whereby a length of the right side elastic line proximate the primary end of the right side elastic line is operable for (i) winding onto the right side spool when the right side spool is rotated in the rotational direction so as to stretch the right side elastic line and thereby create a biasing force favoring rotation of the right side spool in the counter rotation direction, and (ii) unwinding from the right side spool when the right side spool is counter rotated by the bias of the stretched right side elastic line, (i) a left side elastic line having a primary end and a secondary end wherein the secondary end of the left side elastic line is restrained for maintaining a spaced relationship relative to the lateral axis of rotation of the left side spool, and the primary end of the left side elastic line is secured to the left side spool whereby a length of the left side elastic line proximate the primary end of the left side elastic line is operable for (i) winding onto the left side spool when the left side spool is rotated in the rotational direction so as to stretch the left side elastic line and thereby create a biasing force favoring rotation of the left side spool in the counter rotation direction, and (ii) unwinding from the left side spool when the left side spool is counter rotated by the bias of the stretched left side elastic line.

5. The upper body ski motion exercise machine of claim 4 wherein each of the right and left side elastic lines have an intermediate length between the primary and secondary ends looped repeatedly around and between an associated pair of right and left spaced pulleys respectively.

6. The upper body ski motion exercise machine of claim 5 wherein the intermediate length of each of the right side and left side elastic lines are looped at least three times around and between the associated pair of right and left spaced pulleys respectively.

7. The upper body ski motion exercise machine of claim 4 wherein the upper body ski motion exercise machine is compact.

8. The upper body ski motion exercise machine of claim 4 wherein the upper body ski motion exercise machine is elevated.

9. The upper body ski motion exercise machine of claim 4 wherein the upper body ski motion exercise machine is a top mount exercise machine.

10. The upper body ski motion exercise machine of claim 4 wherein the pair of laterally spaced right side and left side spools are rotatable in tandem about a common lateral axis of rotation.

11. The upper body ski motion exercise machine of claim 4 wherein the right side spool and the left side spool rotate independently from one another in both the rotational and counter rotational directions.

12. The upper body ski motion exercise machine of claim 4 wherein:

(a) the right side inelastic line has a length from the first end to the second end, the right side elastic line has a length from the primary end to the secondary end, and the length of the right side elastic line is at least twice the length of the right side inelastic line, and (b) the left side inelastic line has a length from the first end to the second end, the left side elastic line has a length from the primary end to the secondary end, and the length of the left side elastic line is at least twice the length of the left side inelastic line.

13. The upper body ski motion exercise machine of claim 4 wherein:

(a) the right side spool is laterally divided into separate first and second right side zones for individually and separately retaining wound right side inelastic line in the first right side zone and right side elastic line in the second right side zone, and (b) the left side spool is laterally divided into separate first and second left side zones for individually and separately retaining wound left side inelastic line in the first left side zone and left side elastic line in the second left side zone.

14. The upper body ski motion exercise machine of claim 4 wherein the right side and left side spools each have a single continuous helical groove shared by the corresponding set of inelastic and elastic lines with inverse winding and unwinding of the inelastic and elastic lines on each spool.

15. The upper body ski motion exercise machine of claim 4 further comprising a mounting bracket for mounting the upper body ski motion exercise machine to a vertical structure in an elevated position with the right and left grips positioned vertically below the right side and left side spools and the single means for applying resistance.

* * * * *